US008234741B2

(12) United States Patent
Boyd et al.

(10) Patent No.: US 8,234,741 B2
(45) Date of Patent: Aug. 7, 2012

(54) ORAL CARE IMPLEMENT HAVING TISSUE CLEANSER

(75) Inventors: Thomas Boyd, Metuchen, NJ (US); Douglas Hohlbein, Pennington, NJ (US); Joe Vazquez, Township, NJ (US)

(73) Assignee: Colgate-Palmolive Company, New York, NY (US)

( * ) Notice: Subject to any disclaimer, the term of this patent is extended or adjusted under 35 U.S.C. 154(b) by 868 days.

(21) Appl. No.: 12/159,304

(22) PCT Filed: May 6, 2008

(86) PCT No.: PCT/US2008/062782

§ 371 (c)(1),
(2), (4) Date: Jun. 26, 2008

(87) PCT Pub. No.: WO2009/136912

PCT Pub. Date: Nov. 12, 2009

(65) Prior Publication Data

US 2010/0257683 A1 Oct. 14, 2010

(51) Int. Cl.
*A46B 9/04* (2006.01)

(52) U.S. Cl. ..... 15/111; 15/110; 15/167.1; 15/106

(58) Field of Classification Search ..... 15/167.1, 15/110, 111, 236.01, 106, 188, 187
See application file for complete search history.

(56) References Cited

U.S. PATENT DOCUMENTS

| | | | | |
|---|---|---|---|---|
| 1,891,864 | A | 12/1932 | Barrett | |
| 2,491,274 | A | 12/1949 | McNeill | |
| 2,599,191 | A | 6/1952 | Meunier et al. | |
| 2,819,482 | A * | 1/1958 | Applegate | 15/110 |
| 3,337,893 | A | 8/1967 | Fine et al. | |
| 3,943,592 | A | 3/1976 | Bhaskar et al. | |
| 5,133,971 | A | 7/1992 | Copelan et al. | |
| 5,774,925 | A | 7/1998 | Pryor, III | |
| 5,938,673 | A | 8/1999 | DePierro et al. | |
| 5,944,519 | A | 8/1999 | Griffiths | |
| 5,967,152 | A * | 10/1999 | Rimkus | 132/308 |
| 6,015,293 | A | 1/2000 | Rimkus | |
| 6,119,296 | A | 9/2000 | Noe et al. | |
| 6,625,839 | B2 | 9/2003 | Fischer et al. | |
| 6,779,851 | B2 * | 8/2004 | Bouchiere | 300/21 |
| 7,143,462 | B2 | 12/2006 | Hohlbein | |
| 7,273,327 | B2 | 9/2007 | Hohlbein et al. | |

(Continued)

FOREIGN PATENT DOCUMENTS

FR 2 793 136 A 11/2000

(Continued)

OTHER PUBLICATIONS

International Search Report PCT/US2008/062782 Mailed Feb. 26, 2009.

*Primary Examiner* — Shay Karls
(74) *Attorney, Agent, or Firm* — Amy M. Fernandez

(57) ABSTRACT

An oral care implement includes a handle and a head connected to the handle. A tissue cleanser is positioned on the head and has a textured surface and a plurality of apertures extending therethough. Each of a plurality of tissue cleaning elements extends through one of the apertures and extends outwardly from the head.

15 Claims, 2 Drawing Sheets

U.S. PATENT DOCUMENTS

| | | | |
|---|---|---|---|
| 2002/0019645 | A1 | 2/2002 | Fischer et al. |
| 2003/0167582 | A1 | 9/2003 | Fischer et al. |
| 2004/0255416 | A1 | 12/2004 | Hohlbein |
| 2005/0166344 | A1 | 8/2005 | Hohlbein et al. |
| 2005/0210612 | A1 | 9/2005 | Hohlbein et al. |
| 2006/0010628 | A1 | 1/2006 | Moskovich |
| 2006/0026784 | A1 | 2/2006 | Moskovich et al. |
| 2006/0052806 | A1 | 3/2006 | Xi et al. |
| 2006/0057087 | A1 | 3/2006 | Moskovich et al. |
| 2006/0129171 | A1 | 6/2006 | Moskovich |
| 2006/0195995 | A1 | 9/2006 | Moskovich et al. |
| 2007/0101525 | A1 | 5/2007 | Hohlbein |
| 2007/0199168 | A1 | 8/2007 | Blanchard et al. |

FOREIGN PATENT DOCUMENTS

| | | | |
|---|---|---|---|
| WO | 9933374 | A1 | 7/1999 |
| WO | 00/53054 | A1 | 9/2000 |
| WO | 2007032955 | A2 | 3/2007 |
| WO | 2007051203 | A1 | 5/2007 |

* cited by examiner

ORAL CARE IMPLEMENT HAVING TISSUE CLEANSER

CROSS-REFERENCE TO RELATED APPLICATIONS

This application is a national stage entry under 35 U.S.C. §371 of International Patent Application No. PCT/US2008/062782, filed 6 May 2008, which is incorporated herein by reference.

BACKGROUND OF THE INVENTION

The present invention pertains to an oral care implement with a cleanser for cleaning soft tissue surfaces in the mouth.

According to the American Dental Association, a major source of bad breath in healthy people is microbial deposits on the tongue, where a bacterial coating harbors organisms and debris that contribute to bad breath. The tongue is a haven for the growth of microorganisms since the papillary nature of the tongue surface creates a unique ecological site that provides an extremely large surface area, favoring the accumulation of oral bacteria. Anaerobic flora and bacteria residing on the tongue play an important role in the development of chronic bad breath commonly called halitosis. In general, the bacteria produce volatile sulfur compounds (VSC). If there is enough buildup of the sulfur compounds, the result can be bad breath or oral malodor.

Certain known oral care implements incorporate elements for cleaning soft tissue within the mouth, such as the tongue. Certain oral care implements include bladed tongue scrapers, scraping strips, and tongue scalers.

It would be desirable to provide an oral care implement with a tissue cleanser that reduces or overcomes some or all of the difficulties inherent in prior known devices. Particular objects and advantages will be apparent to those skilled in the art, that is, those who are knowledgeable or experienced in this field of technology, in view of the following disclosure of the invention and detailed description of certain embodiments

BRIEF SUMMARY OF THE INVENTION

An oral care implement with a tissue cleanser and tissue cleaning elements advantageously enhances the ability to clean soft tissue surfaces in a user's mouth. In accordance with a first aspect, an oral care implement includes a handle and a head connected to the handle. A tissue cleanser is positioned on the head and has a textured surface and a plurality of apertures extending therethough. Each of a plurality of tissue cleaning elements extends through one of the apertures and extends outwardly from the head.

In accordance with another aspect, an oral care implement includes a handle and a head connected to the handle. A tissue cleanser is positioned on the head and has a textured surface and a plurality of apertures extending therethough. Each of a plurality of nubs extends through one of the apertures and extends outwardly from the head. A scraping member is positioned on the head.

In accordance with a further aspect, an oral care implement includes a handle and a head connected to the handle. A tissue cleanser is positioned on the head and is formed of a first portion having a first textured surface and a second portion having a second textured surface, and has a plurality of apertures extending therethough. Each of a plurality of nubs extends through one of the apertures and extends outwardly from the head. A scraping member is positioned on the head.

Features and advantages disclosed here will be further understood from the following detailed disclosure of certain embodiments.

Figure 1:
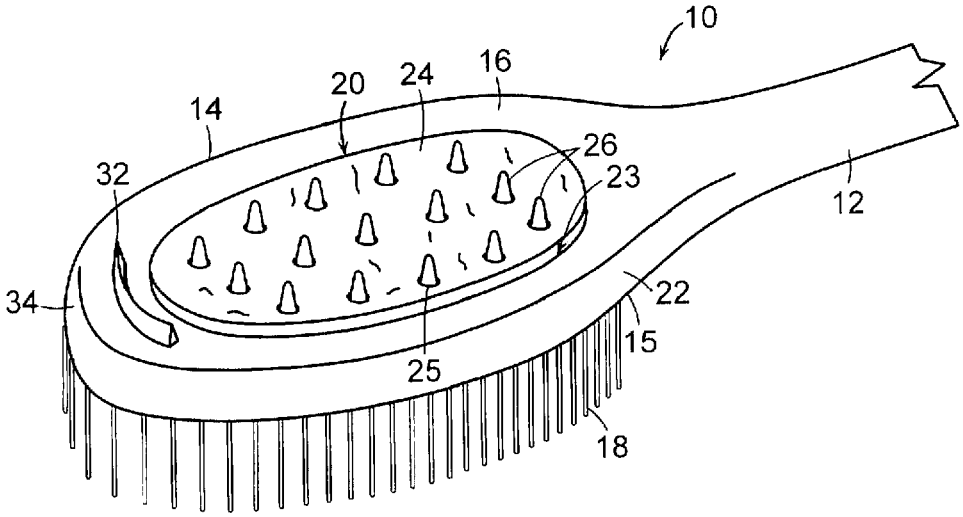
FIG. 1 is a perspective view, partially broken away, of a toothbrush with a tissue cleanser.

The figures referred to above are not drawn necessarily to scale and should be understood to provide a representation of an oral care implement with a tissue cleanser, illustrative of the principles involved. Some features of the oral care implement with a tissue cleanser depicted in the drawings have been enlarged or distorted relative to others to facilitate explanation and understanding. The same reference numbers are used in the drawings for similar or identical components and features shown in various alternative embodiments. An oral care implement with a tissue cleanser as disclosed herein would have configurations and components determined, in part, by the intended application and environment in which they are used.

DETAILED DESCRIPTION OF THE INVENTION

In the following description, the invention is discussed in terms of a toothbrush, but could be in the form of other oral care implements including simply a tissue cleansing implement. Further, it is to be understood that other embodiments may be utilized, and structural and functional modifications may be made without departing from the scope of the present invention.

Figure 2:
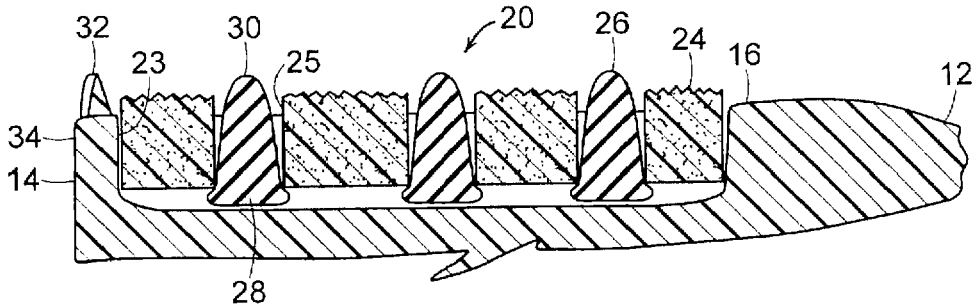
FIG. 2 is a section view, partially broken away, of the head of the toothbrush of FIG. 1.

FIGS. 1-2 illustrate an oral care implement, such as a toothbrush 10, having a handle 12 and a head 14, which may be used for cleaning the teeth and soft tissue in the mouth, such as the tongue, interior surfaces of the cheeks, lips or the gums. Handle 12 is provided for the user to readily grip and manipulate the toothbrush, and may be formed of many different shapes and constructions. While head 14 is normally widened relative to the neck of handle 12, it could in some constructions simply be a continuous extension or narrowing of handle 12.

In certain embodiments, head 14 has a first face 15 that supports a plurality of tooth cleaning elements 18. As used herein, the term "tooth cleaning elements" can include any type of structure that is commonly used or is suitable for use in providing oral health benefits (e.g., tooth cleaning, tooth polishing, tooth whitening, massaging, stimulating, etc.) by making contact with portions of the teeth and gums. Such tooth cleaning elements include, but are not limited to, tufts of bristles that can be formed to have a number of different shapes and sizes, and elastomeric cleaning members that can be formed to have a number of different shapes and sizes, or a combination of both tufts of bristles and elastomeric cleaning members.

Head 14 has a second face 16 that supports a tissue cleanser 20. First and second faces 15, 16 are preferably on opposite sides of head 14. Nevertheless, tissue cleanser 20 may be mounted elsewhere, such as at the proximal end of handle 12. Tissue cleanser 20, or portions of it, may also be located on a peripheral sidewall surface 22 of head 14 or extend farther towards the proximate end of handle 12 than illustrated. Tissue cleanser 20 may be seated within a recess 23 formed in second face 16. Tissue cleanser 20 may be secured to head 14 with a suitable fastener, such as adhesive, or any other suitable mechanical fastener.

Tissue cleanser 20 has an irregular or textured outer surface 24. In certain embodiments, tissue cleanser 20 is formed of sponge or a sponge-like material. Suitable sponges include natural sponge as well as man-made sponge and sponge-like materials. In other embodiments, tissue cleanser 20 may be formed of a fabric. The fabric may be, for example, an extruded molded fabric. The fabric may also be a woven or non-woven material. Regardless of the type of material of which tissue cleanser 20 is formed, surface irregularities extend across textured outer surface 24, thereby providing the ability of tissue cleanser to engage and clean the soft tissue surfaces of the user's mouth.

Figure 3:
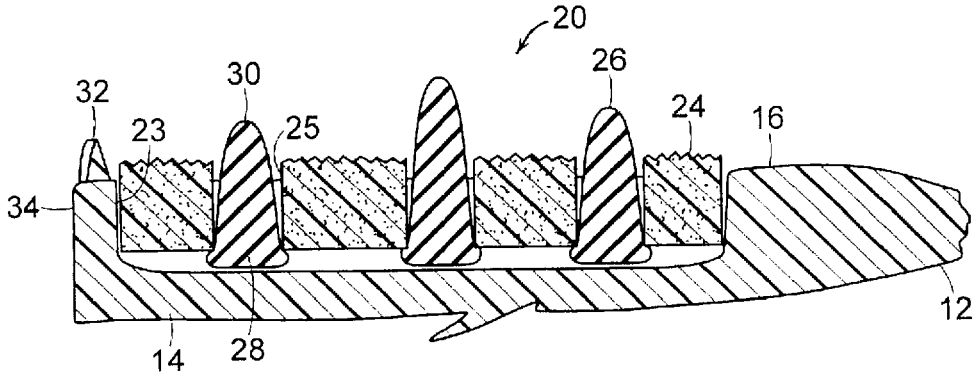
FIG. 3 is a section view, partially broken away, of an alternative embodiment of the head of the toothbrush of FIG. 1.

Tissue cleanser 20 has a plurality of apertures 25 extending therethrough. Each of a plurality of tissue engaging elements 26 extends through one of the apertures 25. In certain embodiments, the height of each tissue engaging element 26 is greater than the height of tissue cleanser 20. As illustrated here, each tissue engaging element 26 has the same height as the other tissue engaging elements 26. In other embodiments, as illustrated in FIG. 3, the tissue engaging elements 26 may have different heights. Thus, in certain embodiments, at least one tissue engaging element 26 has a height that is different than the height of at least one other tissue engaging element 26.

In certain embodiments, tissue engaging elements 26 are formed as nubs. As used herein a "nub" is generally meant to include a column-like protrusion (without limitation to the cross-sectional shape of the protrusion) which is upstanding from a base surface. In a general sense, the nub, in the preferred construction, has a height that is greater than the width at the base of the nub (as measured in the longest direction). Nevertheless, nubs could include projections wherein the widths and heights are roughly the same or wherein the heights are somewhat smaller than the base widths. Moreover, in some circumstances (e.g., where the nub tapers to a tip or includes a base portion that narrows to a smaller projection). The base width can be substantially larger than the height.

As seen in FIG. 2, in one preferred arrangement of tissue cleanser 20, tissue engaging elements 26 are preferably conically shaped. As used herein, "conically shaped" or "conical" is meant to include true cones, frusto-conically shaped elements, and other shapes that taper to a narrow end and thereby resemble a cone irrespective of whether they are uniform, continuous in their taper, or have rounded cross-sections. In the illustrated embodiment the base portion 28 of each conically shaped tissue engaging element 26 is larger than the corresponding tip portion 30. In this conically shaped configuration, the base portion 28 has a wider cross-sectional area to provide effective shear strength to withstand the lateral movement of the tissue cleanser 20 along the surface of the tongue or other soft tissue surface. The smaller width or diameter of the tip portion 30 in conjunction with the length of the conically shaped tissue engaging element 26 enable the tissue engaging elements 26 to sweep into the recesses of the tongue and other surfaces to clean the microbial deposits and other debris from the soft tissue surfaces. In the preferred construction, tissue engaging elements 26 are able to flex and bend from their respective vertical axes as lateral pressure is applied during use. This flexing enhances the comfort and cleaning of the soft tissue surfaces.

In certain embodiments, a scraping member 32 is provided on head 14. In the illustrated embodiment, scraping member 32 is a thin blade or ridge-like projection extending outwardly from face 16 of head 14. Scraping member 32 may be positioned at the distal end 34 of head 14, as illustrated here, or it may be positioned at any position along head 14. In the illustrated embodiment, scraping member 32 is curved along distal end 34 of head 14. It is to be appreciated that scraping member 32 may have a straight configuration, or any other desired shape. Scraping member 32 may be formed of any thermoplastic or elastomer material or combination thereof.

In the preferred construction (FIGS. 1-6), tissue cleanser 20 may rub against the inside surfaces of the cheeks or lips, and on the sides of the tongue while the user brushes his or her teeth, and thus provide a desired massaging, stimulation and cleaning of various soft tissue surfaces within the mouth. For example, during brushing of the facial tooth surfaces, tissue cleanser 20 is disposed on the outer face 16 of head 14 to naturally rub against the oral surfaces of the cheek. As a result, enhanced cleaning is attained without additional cleaning steps. Further, some users may sense a stimulating tingle on the inner cheek surfaces that leads to a positive user reaction, and even enjoyment of the comfortable feel of tissue cleanser 20 along the soft tissues surfaces in the mouth. Tissue cleanser 20 may also be additionally rubbed on the cheeks, tongue, etc. as desired for further cleaning aside from the contact that may occur while brushing the teeth.

Tissue cleanser 20 provides the ability to clean away bacterial biofilm and cellular debris on the tongue and cheeks and, therefore, is designed to significantly reduce a major source of bad breath in people and improve hygiene. Tissue cleanser 20 enables removal of microflora and other debris from the tongue and other soft tissue surfaces within the mouth. The tongue, in particular, is prone to develop bacterial coatings that are known to harbor organisms and debris that can contribute to bad breath. This microflora can be found in the recesses between the papillae on most of the tongue's upper surface as well as along other soft tissue surfaces in the mouth. When engaged or otherwise pulled against a tongue surface, for example, tissue engaging elements 26, textured surface 24 of tissue cleanser 20, and scraping member 32 provide for gentle engagement with the soft tissue while reaching downward into the recesses of adjacent papillae of the tongue. Moreover, the soft tissue engaging elements 26 are able to flex as needed to traverse and clean the soft tissue surfaces in the mouth along which it is moved.

It is to be appreciated that in certain embodiments, tissue engaging elements 26 may be configured to retract and extend with respect to head 14 and the surface of tissue cleanser 20. For example, during regular brushing of the teeth with tooth cleaning elements 18, tissue engaging elements 26 could be in a retracted, or somewhat retracted, position, extending only partially through apertures 25, thereby providing comfort for the cheeks. Then, when force is applied in the opposite direction on brush head 14 to rub tissue cleansers 26 against mouth tissue surfaces, tissue cleansers 26 could extend outwardly further from the surface of tissue cleanser 20, thereby providing enhanced cleansing and allowing tissue cleansers 26 to reach deep into tongue crevices.

Figure 4:
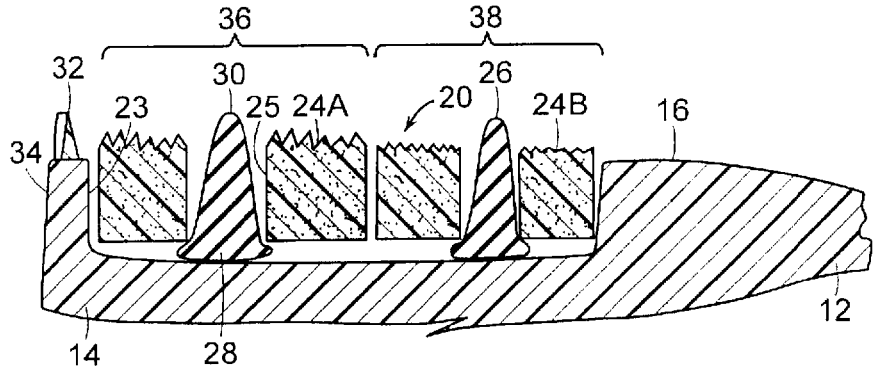
FIG. 4 is a section view, partially broken away, of another alternative embodiment of the head of the toothbrush of FIG. 1.

In certain embodiments, as illustrated in FIG. 4, tissue cleanser 20 is formed of a first portion 36, and a second portion 38 that is positioned adjacent first portion 36 toward the proximal end of head 14. First portion 36 has an outer surface 24A having a first texture, and second portion 38 has an outer surface 24B having a second texture, which may be different than that of the first texture. In certain embodiments, the first texture is coarser than that of the second texture and, naturally, the second texture is finer that that of the first texture. In other words, the first texture of first portion 36 is rougher, or less smooth than that of the second texture of second portion 38. The outer surface 24A of first portion 36 will, therefore, have larger and/or more frequent surface irregularities as compared to that of outer surface 24B of second portion 38. It is to be appreciated that in other embodiments, the second texture could be rougher, or coarser, than that of the first texture.

The different textures of outer surfaces 24A, 24B of first and second portions 36, 38, respectively, can be achieved, for example, by providing different grades or coarseness levels of the same material. For example, first and second portions 36, 38 may both be formed of a sponge or sponge-like material, with first portion 36 having a type of sponge that has a coarser texture than that of second portion 38.

In other embodiments, first and second portions 36, 38 could be formed of different materials. For example, first portion 36 could be formed of a fabric with a relatively coarse first texture as compared to that of second portion 38, while second portion 38 could be formed of a sponge having a second texture that is relatively fine as compared to the first texture of first portion 36.

Figure 5:
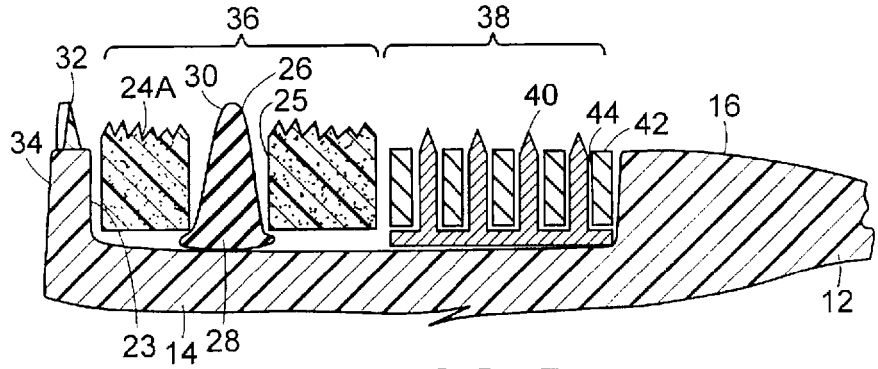
FIG. 5 is a section view, partially broken away, of yet another alternative embodiment of the head of the toothbrush of FIG. 1.

In certain embodiments, as seen in FIG. 5, second portion 38 may be formed of a field of short bristles 40 seated in a carrier 42, with each bristle 40 extending through an aperture 44 formed in carrier 42. In the illustrated embodiment, substantially the entire portion of each bristle 40 that extends outwardly beyond carrier 42 is tapered.

In the illustrated embodiment, bristles 40 are attached via anchor free tufting (AFT). In the AFT brush making process, described in detail in U.S. Pat. No. 6,779,851 (the entire disclosure of which is incorporated herein by reference in its entirety), nylon is fed into a pre-molded plate that can be made from any thermoplastic or elastomer material or combination thereof. This nylon may be processed into bristle tufts of various sizes and shapes. The non-use or proximal end of the nylon is heated and melted to retain the nylon in the brush head when a reasonable pulling force is applied.

Figure 6:
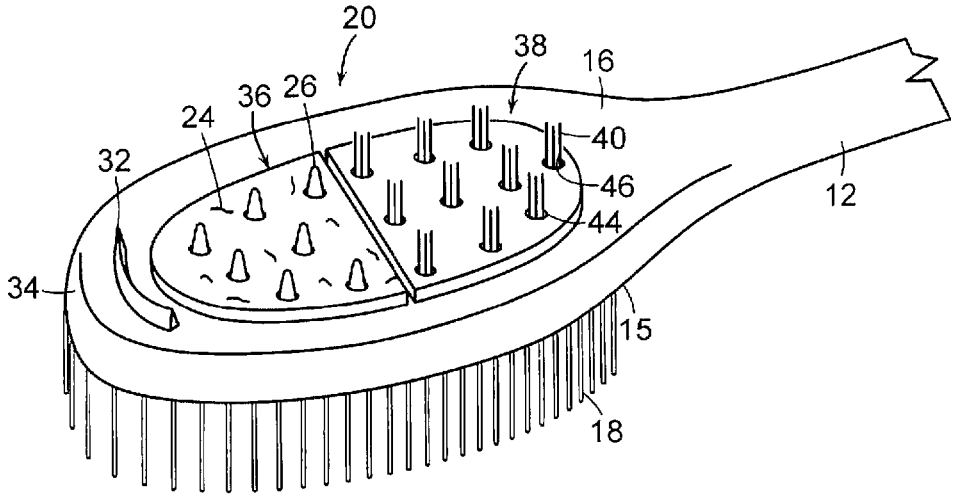
FIG. 6 is a perspective view, partially broken away, of an alternative toothbrush with a tissue cleanser.

Bristles 40 may be seated relatively close to one another in an array as illustrated in FIG. 5. In other embodiments, however, as illustrated in FIG. 6, bristles 40 may be positioned in bristle tuft groups 44 that are spaced from one another by a significant distance as compared to the bristle field as shown in FIG. 5.

In certain embodiments, bristles 40 may have a height in the range of approximately 1 mm to approximately 6 mm and in other embodiments in the range of approximately 1.5 mm to approximately 4 mm. Such bristles are relatively short in comparison to their column width, which preferably is in the range of approximately 0.06 to approximately 0.18 mm+/−0.02 mm for individual bristles 40 and in the range of approximately 1 mm to approximately 2 mm+/−0.2 mm for bristle tuft groups 44. As such, the bristles 40 of tooth cleanser 20 have a relatively high column strength in comparison with bristles of more typical tooth cleaning elements such as cleaning elements 18, which are longer and more flexible than bristles 40 of tissue cleanser 20. Due to their thin diameter and their high column strength, the relatively short tissue cleaning elements and, in particular, the relatively short filament bristles are able to penetrate very well into the user's soft oral tissues.

In light of the foregoing disclosure of the invention and description of various embodiments, those skilled in this area of technology will readily understand that various modifications and adaptations can be made without departing from the scope and spirit of the invention.

We claim:

1. An oral care implement comprising:

a handle;

a head having a first face and a second face opposite the first face, the head connected to the handle;

a plurality of tooth cleaning elements supported by the first face;

a tissue cleanser on the second face of the head having a first height and a textured surface;

a plurality of apertures extending through the entire first height of the tissue cleanser; and a plurality of tissue engaging elements, each tissue engaging element extending through one of the apertures and extending outwardly from the head;

each tissue engaging element having a height that is greater than the first height of the tissue cleanser;

each tissue engaging element having a base portion and a tip portion, wherein the base portion is larger than the tip portion.

2. The oral care implement of claim 1, wherein the tissue cleanser is formed of sponge.

3. The oral care implement of claim 1, wherein the tissue cleanser is formed of a fabric.

4. The oral care implement of claim 3, wherein the fabric is one of woven and nonwoven.

5. The oral care implement of claim 1, wherein the tissue engaging elements are formed of an elastomeric material.

6. The oral care implement of claim 1, wherein the tissue engaging elements are nubs.

7. The oral care implement of claim 1, further comprising a scraping member extending outwardly from the second face of the head.

8. The oral care implement of claim 1, wherein a height of at least one tissue engaging element is different than a height of at least one other tissue engaging element.

9. The oral care implement of claim 1, wherein the tissue cleanser is formed of a first portion having a first textured surface and a second portion having a second textured surface, the second portion being positioned adjacent the first portion in a direction toward a proximal end of the head.

10. The oral care implement of claim 9, wherein the first textured surface is coarser than the second textured surface.

11. The oral care implement of claim 9, wherein the first portion and second portion are formed of different materials.

12. The oral care implement of claim 9, wherein the second portion includes a plurality of bristles.

13. The oral care implement of claim 12, wherein the bristles have a height in the range of approximately 1 mm to approximately 6 mm.

14. The oral care implement of claim 12, wherein the bristles are secured to the head via AFT.

15. The oral care implement of claim 1, wherein the tissue cleanser comprises an outer surface protruding beyond the second face of the head.

* * * * *